US007786364B2

(12) United States Patent
Natali

(10) Patent No.: US 7,786,364 B2
(45) Date of Patent: Aug. 31, 2010

(54) PERCUSSION MUSICAL INSTRUMENT

(76) Inventor: Carlo Natali, Via Degli Ausoni 7, Roma (IT) 00185

( * ) Notice: Subject to any disclaimer, the term of this patent is extended or adjusted under 35 U.S.C. 154(b) by 0 days.

(21) Appl. No.: 12/243,040

(22) Filed: Oct. 1, 2008

(65) Prior Publication Data

US 2009/0308225 A1 Dec. 17, 2009

(30) Foreign Application Priority Data

Jun. 11, 2008 (IT) ..... RM2008A0305

(51) Int. Cl.
*G10D 13/02* (2006.01)

(52) U.S. Cl. ..... 84/412; 84/411 R

(58) Field of Classification Search ..... 84/411 R, 84/412
See application file for complete search history.

(56) References Cited

U.S. PATENT DOCUMENTS 578,198 A * 3/1897 Boulanger ..... 84/411 R
663,854 A * 12/1900 Boulanger ..... 84/411 R
673,633 A * 5/1901 Boulanger ..... 84/411 R
834,865 A * 10/1906 Berlinghopf ..... 84/412
881,109 A * 3/1908 Cipar ..... 84/412
1,113,253 A * 10/1914 Schreiner ..... 84/412
1,214,171 A * 1/1917 King ..... 84/412
1,223,237 A * 4/1917 Barry ..... 84/412
1,420,233 A * 6/1922 Baldwin et al. ..... 84/411 R
1,456,242 A * 5/1923 Leedy ..... 84/411 R
1,768,438 A * 6/1930 Clark ..... 84/412
2,546,452 A * 3/1951 Kmieliauskas ..... 84/412
2,563,346 A * 8/1951 Livingston ..... 84/412
3,215,021 A * 11/1965 Kester, Jr. ..... 84/411 R
3,651,973 A * 3/1972 Yamauchi ..... 215/11.3
4,060,019 A * 11/1977 Cordes ..... 84/411 R
4,300,437 A * 11/1981 Hinger et al. ..... 84/411 R
4,455,913 A * 6/1984 Willis ..... 84/412
4,978,021 A * 12/1990 Mini et al. ..... 220/8
5,226,551 A * 7/1993 Robbins, III ..... 220/8
6,462,262 B2 * 10/2002 Hagiwara ..... 84/411 R
6,666,329 B1 * 12/2003 Charbonneau ..... 206/218
6,805,144 B2 * 10/2004 Usui et al. ..... 135/34.2
7,506,611 B1 * 3/2009 Lush ..... 119/52.1
7,617,927 B1 * 11/2009 Smith, Jr. ..... 206/15.3
2004/0232016 A1 * 11/2004 Dietrich ..... 206/315.3
2009/0308225 A1 * 12/2009 Natali ..... 84/411 R
2009/0308226 A1 * 12/2009 Paterson ..... 84/412

* cited by examiner

*Primary Examiner*—Jeffrey Donels
*Assistant Examiner*—Robert W Horn
(74) *Attorney, Agent, or Firm*—Young & Thompson

(57) ABSTRACT

A percussion musical instrument comprises a beating surface (13) fastened to a shell (2), the shell (2) comprises at least two, preferably three or more, hollow shells (4) telescopically coupled to each other and movable along a common axis (X) of translation at least between a closed configuration in which a hollow body contains at least partially the next hollow body and an open configuration in which the hollow bodies are substantially superposed.

17 Claims, 7 Drawing Sheets

PERCUSSION MUSICAL INSTRUMENT

BACKGROUND OF THE INVENTION

The present invention relates to a percussion musical instrument, in particular a drum Drums are percussion musical instruments that comprise a shell, i.e. a hollow tubular body, closed at a first end by a membrane and closed at a second end, opposite the first, by a disk made of non-deformable material or by an additional membrane. The membrane, or both membrane if two membranes are present, is made with synthetic or natural materials, e.g. animal hide, Mylar, and the like.

If two membranes are present, the membrane on which the initial vibration is generated is called beating membrane, whilst the other membrane, whose purpose is to influence the timbre of the generated sound, is called resonating membrane. The shell collects the vibration of the beating membrane in the contact area therewith and it serves as a resonating cylinder.

The material whereof the shell is made characterizes the timbre of the instrument, which has a warm sound in the case of shells made of natural material, such as wood, and a more brilliant sound with more harmonics in the ease of shells made of metal or plastic materials.

The membranes are set on the peripheral edge of hoops that in turn are fastened to the outer lateral wall of the shell. By adjusting the tension of the membranes on the hoop, the intonation of the instrument is adjusted.

The principle of operation of a drum consists, as mentioned above, of exploiting the volume of the shell to amplify the sound wave generated by hitting the beating membrane.

Hence, the volume and the bulk of the drum are a constraint to which the musician must be subjected to obtain a determined result.

However, at times an excessive bulk forces the musician to sacrifice sound quality in favor of the transportability of the drum and its positioning in the location. This drawback is still more accentuated when the instrument comprises a set of drums, as is the case in modern music.

In this context, the technical task of the present invention is to propose a percussion musical instrument that is free of the aforesaid drawbacks.

SUMMARY OF THE INVENTION

In particular, an object of the present invention is to propose a percussion musical instrument that is easily transportable and storable without sacrificing sound quality when in use. In accordance with the present invention, the described technical task and object are achieved by a percussion musical instrument comprising the technical characteristics exposed in one or more of the appended claims.

BRIEF DESCRIPTION OF THE DRAWINGS

Further characteristics and advantages of the present invention shall become more readily apparent from the indicative, and therefore non limiting, description of a preferred but not exclusive embodiment of a percussion musical instrument, as illustrated in the accompanying drawings in which.

DESCRIPTION OF THE PREFERRED EMBODIMENTS

Figure 1:
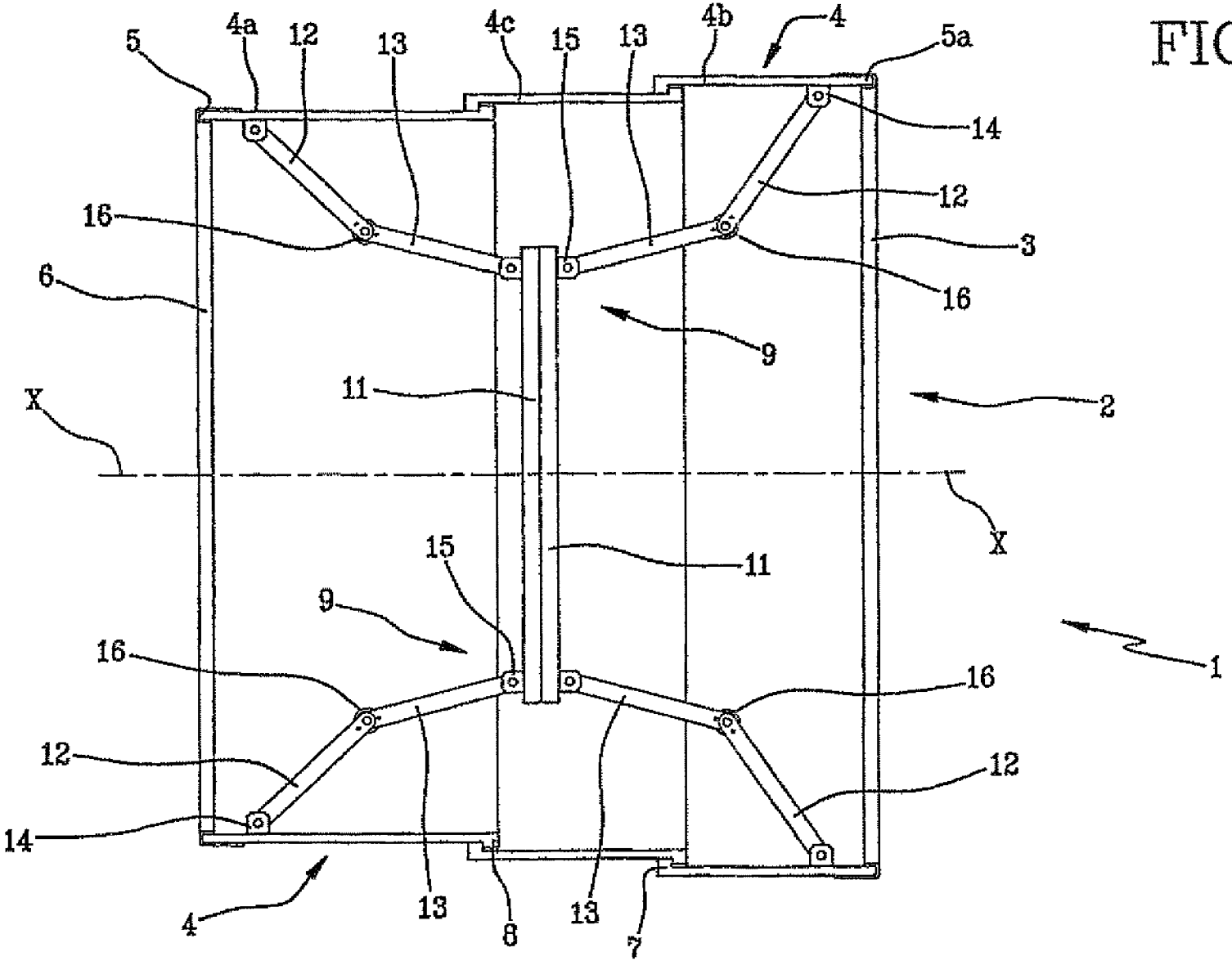
FIG. 1 shows a schematic sectioned view of a percussion musical instrument according to the present invention in a first operative configuration.

With reference to the accompanying figures, the number 1 indicates, in its entirety, a percussion musical instrument in accordance with the present invention.

The accompanying figures and the description that will follow make specific reference, for the sake of descriptive clarity, to a bass drum, however the present invention can be embodied with any percussion musical instrument provided with a beating surface or membrane and with an amplifying shell.

The instrument 1 comprises a shell 2 whereto is fastened a beating surface 3. The beating surface 3 can be a membrane made of natural material, e.g. a hide, or a membrane made of synthetic material, or yet again a rigid surface. The shell 2 comprises at least two hollow bodies 4, in particular a first end hollow body 4*a* and a second end hollow body 4*b*. The term "hollow body" means, in the context of the present invention, a shell having a lateral wall that delimits a cavity. In other words, each hollow body is a shell of a drum.

Preferably, each hollow body 4 has a substantially cylindrical shape, however each hollow body can have any prismatic shell adapted to be used as a drum shell. An 15 example of additional shape of the hollow body is the cone frustum shape.

At one end 5 of the first end hollow body 4*a* is fastened a resonating surface 6, or a closing surface, or said end 5*a* can be open, depending on the percussion musical instrument to be obtained (in the accompanying figures, a resonating surface is shown).

The second end hollow body 4*b* presents, at its end 5*a*, the aforementioned beating surface 3. The shell 2 further comprises one or more central hollow bodies 4*c*, i.e. positioned between the two end hollow bodies 4*a*, 4*b* (in the accompanying figures, only one central hollow body 4*c* is shown). The central hollow bodies 4*c* are open at both ends. Advantageously, the hollow bodies 4 are movable relative to each other along a common axis of translation X at least between one closed configuration (shown in FIG. 2) in which a hollow body contains at least partially the other hollow body, or the other hollow bodies (depending on the number of hollow bodies 4), and an open configuration (shown in FIG. 1) in which the hollow bodies 4 are substantially superposed.

Figure 2:
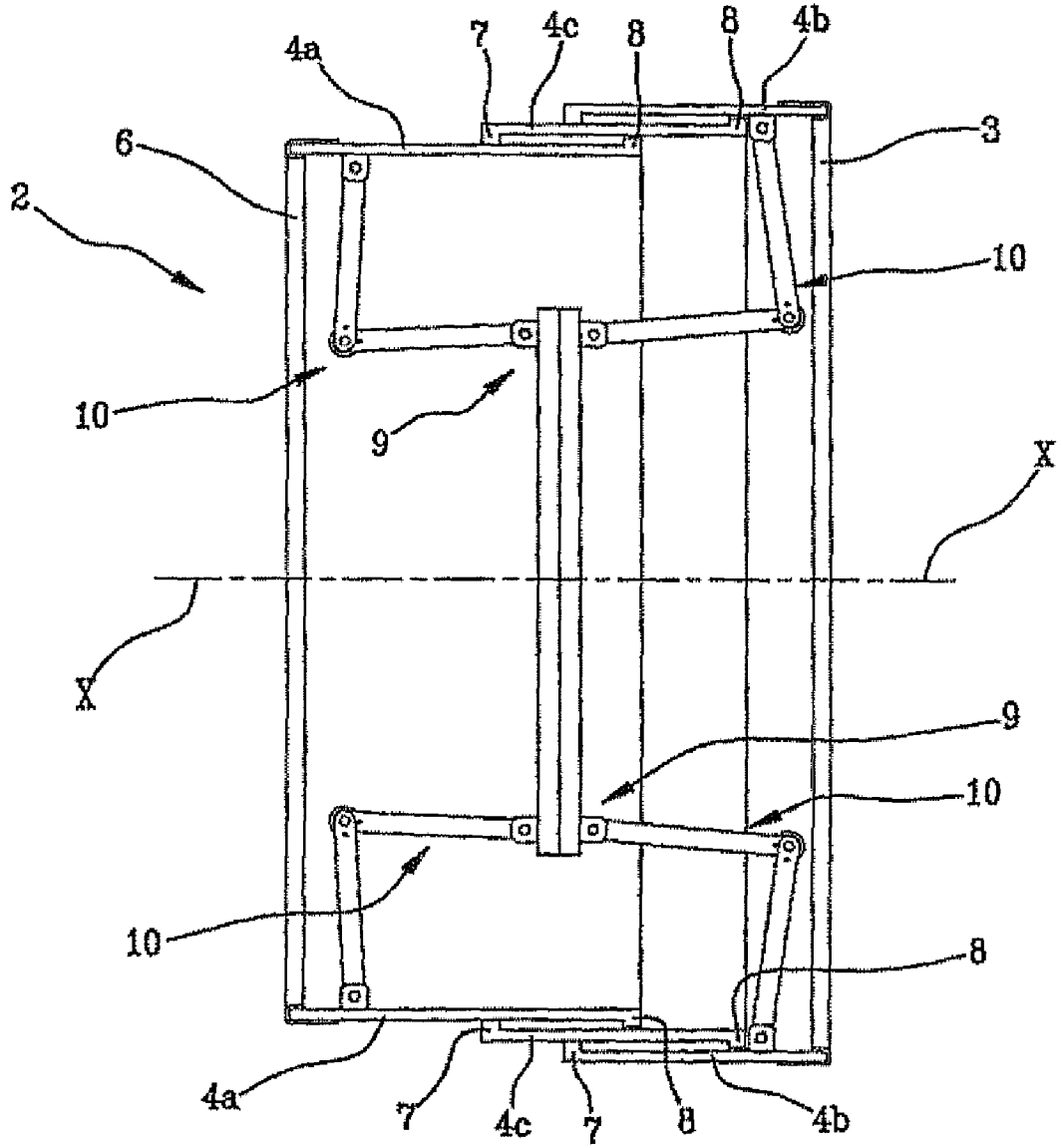
FIG. 2 shows the instrument of FIG. 1 in a second operative configuration.

In particular, the hollow bodies 4 are telescopically coupled to each other, and they have dimensions transverse to the axis X of translation that are progressively larger proceeding from an end hollow body 4*a* to the other end hollow body 4*b*. In this way, in the closed configuration the hollow bodies 4 are inserted inside each other, possibly with each hollow body projecting slightly from the hollow body that contains it (as shown in FIG. 2).

As stated above, in open configuration the hollow bodies 4 are substantially superposed; given the telescopic configuration of the hollow bodies 4, it is readily apparent that the words "substantially superposed" mean that each hollow body projects almost completely outside the adjacent hollow body having greater transverse dimensions (as shown in FIG. 1).

The end hollow body 4*b* presenting greater transverse dimension comprises an annular undercut 7, i.e. an abutment ring, which develops along an end opposite to the end 5*b* which bears the resonating membrane 6.

The central hollow body 4*c* inserted telescopically in the aforesaid end hollow body 4*b* comprises an annular projection 8 which engages in abutment against the annular undercut 7 in the open configuration (see FIG. 1). In this way, the central hollow body 4*c* is prevented from being completely extracted from the end hollow body 4*b*.

The central hollow body 4*c* further comprises an annular undercut 7 positioned at the opposite end that bears the annular projection 8.

The other end hollow body 4*a* comprises an annular projection 8 which engages in abutment against the annular undercut 7 of the central hollow body 4*c* in the open configuration (see FIG. 1). In this way, the end hollow body 4*a* is prevented from being completely extracted from the central hollow body 40, When all the hollow bodies 4 present the respective annular projections in abutment against the annular undercuts 7, the drum I is in a configuration of maximum extension.

The annular undercuts 7 and the annular projections 8 can be provided with sealing gaskets if the shell 2 has to be air tight. Advantageously, the drum 1 comprises actuating means 9 to move the hollow bodies 4 between the open position, the closed configuration and at least one partially open configuration. The actuating means 9 are coupled to the hollow bodies 4 preferably within them, i.e., within the cavity defined thereby.

The actuating means 9 present a degree of rotational freedom relative to the hollow bodies 4 to enable them to rotate independently of each other around the shared axis of translation X.

In this way, an accidental rotation, e.g. during transport, of a hollow body 4 5 relative to the others does not damage either the hollow bodies 4 or the actuating means 9.

In the preferred embodiment of the invention, shown in FIGS. 1 and 2, the actuating means 9 comprise a first array of thruster elements 10 active between an end hollow body 4*a* and a first abutment surface it and a second array of thruster elements 10 active between the other end hollow body 4*b* and a second abutment surface 11.

The two abutment surfaces 11 face each other and are in permanent mutual contact.

The two abutment surfaces 11 are not fastened to each other, such that they can 15 rotate freely and mutually around the axis of translation X.

In this regard, it should be noted that the two abutment surfaces 11 lie in respective planes substantially perpendicular to the axis of translation X.

Preferably there are at least two arrays of thruster elements 10, still more preferably there are three, and they are mutually equidistant by about 120°.

Alternatively, there are four arrays of thruster elements 10. Each array of thruster elements 10 comprises a first rod-like element 12 hinged to an end hollow body 4*a*, 4*b* and a second rod-like element 13 hinged to the respective abutment surface. Preferably, the two rod-like elements 12, 13 are not directly hinged to the hollow body and to the abutment surface 11 but are hinged to respective appendages 14, 15 which in turn are integral with the end hollow body and with the abutment surface 11.

Said appendages 14, 15 extend towards the center of the hollow bodies 4 to prevent the rod-like elements 12, 13 from touching, and hence damaging, the beating surfaces and/or the resonating surface when the drum 1 is in closed configuration.

Elastic means 16 act between the first 12 and the second rod-like element 13 to thrust an abutment surface 11 towards and against the other abutment surface 11.

Preferably, said elastic means 16 are constituted by torsion springs positioned at the hinge points between the first 12 and the second rod-like elements 13. The axes of rotation of the thruster elements, i.e. the axes around which rotate the rod-like elements 12, 13, are perpendicular to the axis X of translation and they are parallel to the planes of lay of the abutment surfaces 11. The abutment surfaces 11 are preferably embodied by hoops.

Figure 3:
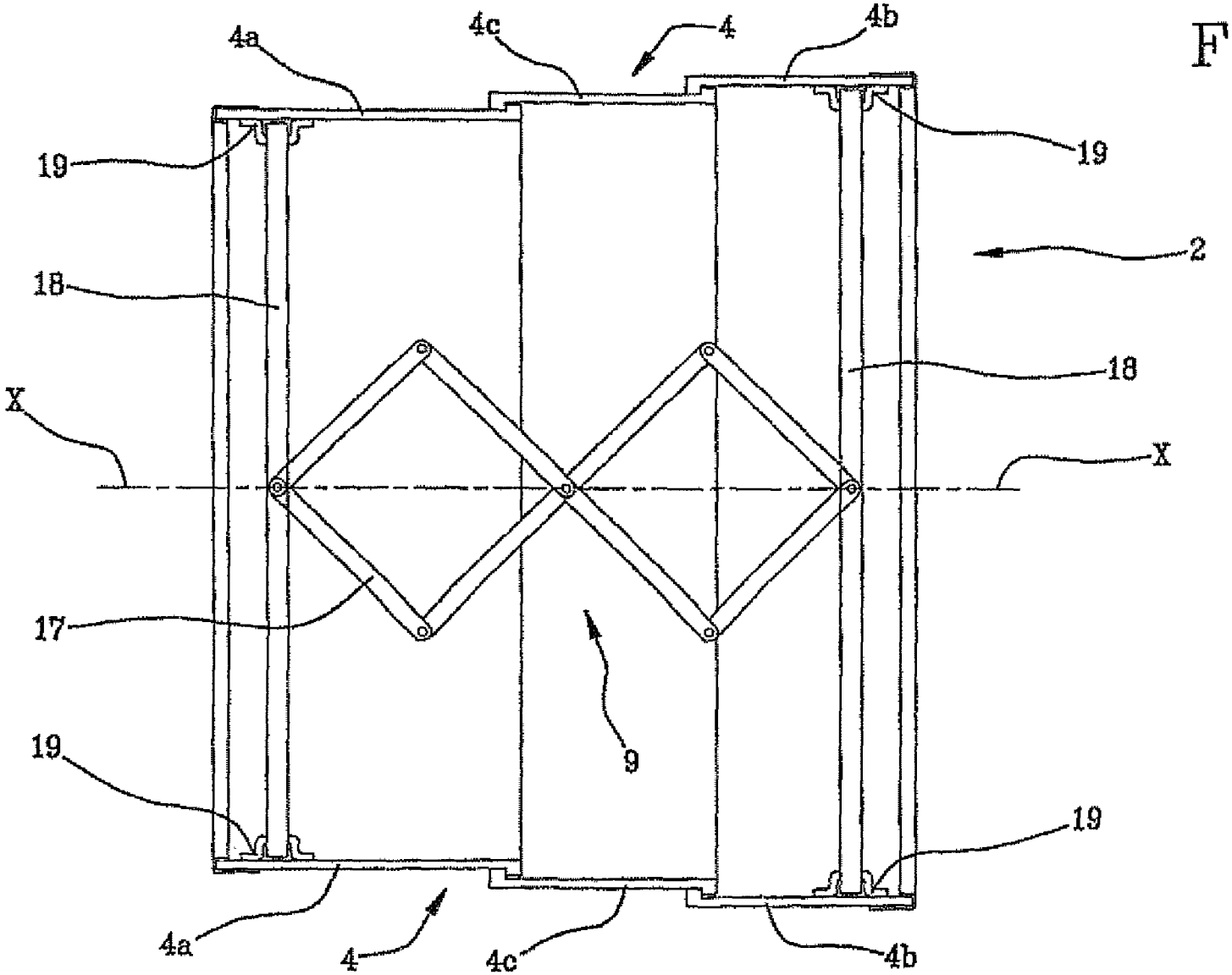
FIG. 3 shows a schematic sectioned view of a first embodiment variant of the 20 musical instrument of FIG. 1.

In a first alternative embodiment of the invention, shown in FIG. 3, the actuating means 9 comprise a structure 17 substantially shaped as a pantograph, which is rotatably fastened to two end hollow bodies 4*a*, 4*b*.

The term "pantograph structure" means, within the context of the present 10 invention, a substantially lattice-like structure, articulated in such a way as to be deformable moving respective end portions closer to, and farther away from each other.

In particular, the pantograph structure 17 is integral, in two opposite ends, with respective hoops 18, Said hoops 18 are fastened to the end hollow bodies 4*a*, 4*b* in such a way as to be able to rotate around the axis X of translation and not to be able to translate along the same axis X.

In the embodiment shown in FIG. 3, the engagement between the hoops 18 and the end hollow bodies 4*a*, 4*b* is provided by slots 19 rigidly fastened to the end hollow bodies within which the hoops 18 pass and slide freely.

In this way, the hollow bodies 4 are free to rotate relative to each other around the axis X of translation without damaging or compromising the pantograph structure.

Figure 4:
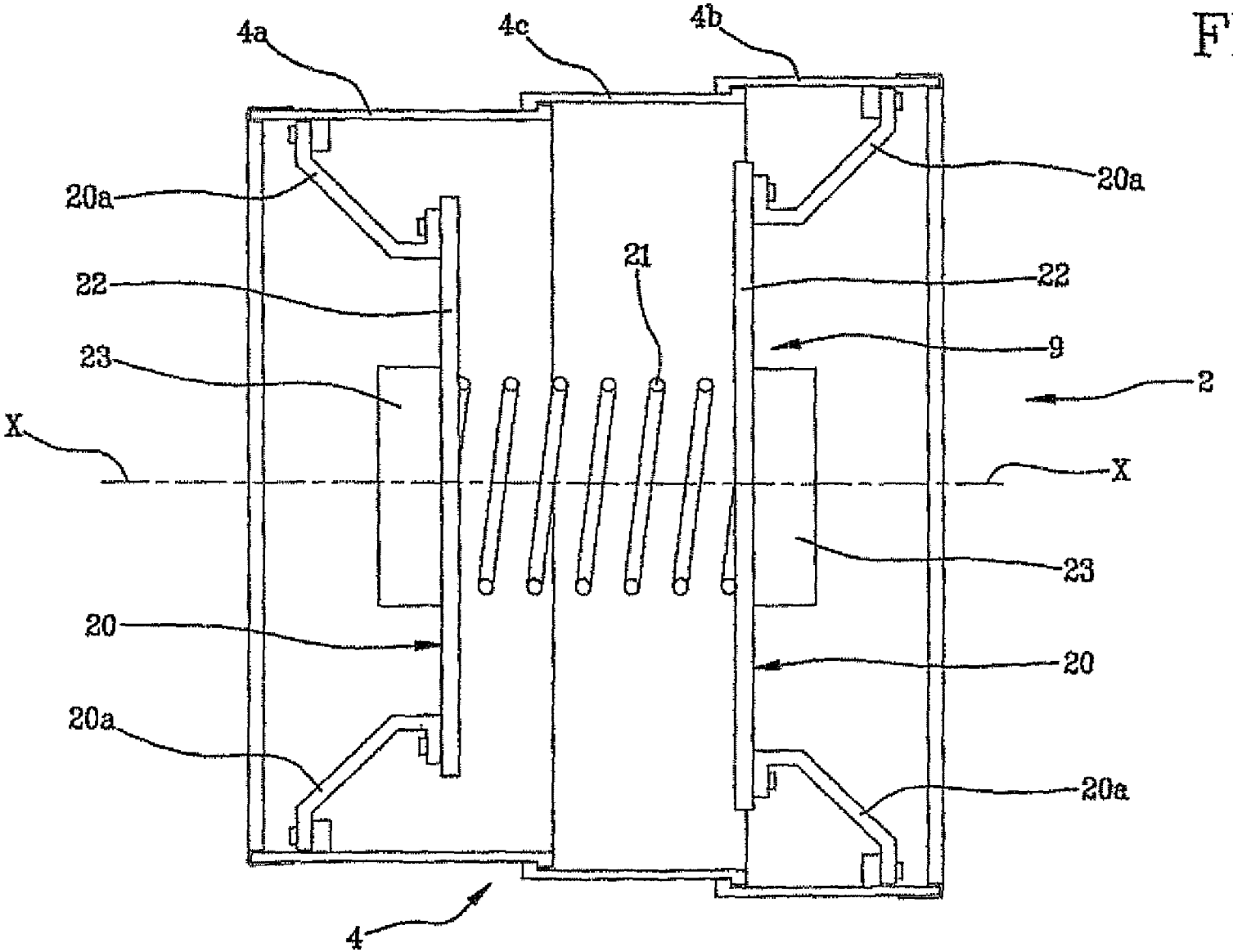
FIG. 4 shows a schematic sectioned view of a second embodiment variant of the musical instrument of FIG. 1.

FIG. 4 shows a second alternative embodiment of the actuating means 9.

In this embodiment, the actuating means 9 comprise a first support element 20 fastened to an end hollow body 4*a*, a second support element 20 fastened to the other end hollow body 4*b* and an elastic element 21 interposed between the two support elements 20.

Each support element 20 comprises two, preferably three appendages 20*a* which, at a first end, are rigidly fastened to the end hollow body and, at the end opposite to the first, they are rigidly fastened to a support plate 22.

The support plate 22 is fastened to a cup 23 that has an opening oriented towards the center of the drum 2.

The aforementioned elastic element 21 is positioned between the two cups 23 and it is free to rotate around the axis X of translation relative to the two cups.

Preferably, the elastic element 21 is a linear spring.

In this way, the hollow bodies 4 are free to rotate relative to each other around the 5 axis X of translation without damaging the support structures 20 and the elastic element 21.

Figure 5:
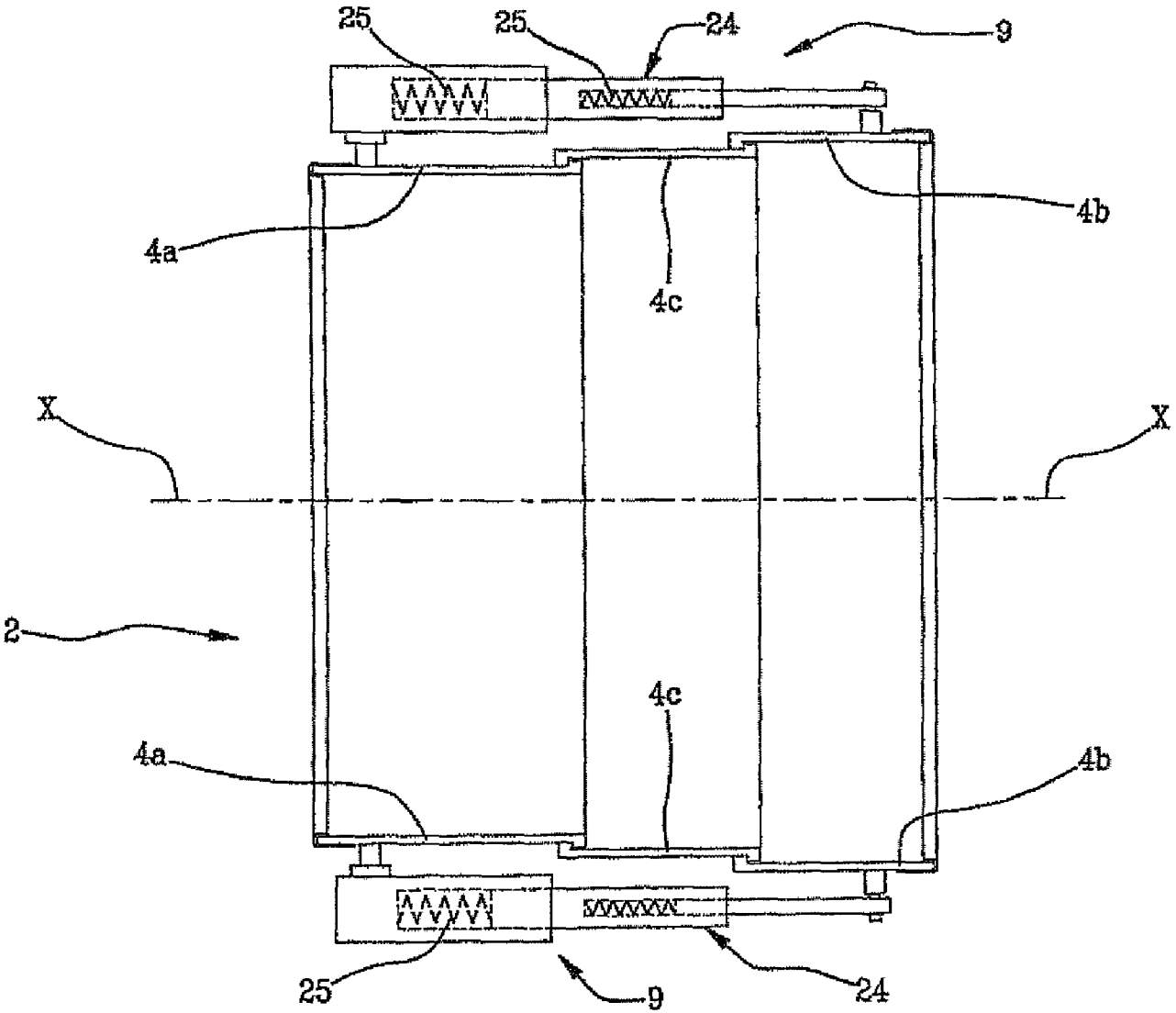
FIG. 5 shows a schematic sectioned view of a third embodiment variant of the musical instrument of FIG. 1.

An additional embodiment is shown in FIG. 5.

In this case, the actuating means 9 comprise a plurality of telescopic cylinders 24 fastened to the two end hollow bodies 4*a*, 4*b* externally thereto.

The telescopic cylinders 24 are provided with elastic means 25, preferably linear springs, to extend completely.

Preferably, there are three telescopic cylinders, equidistant by 1200 along the lateral surface of the shell 2.

Figure 6:
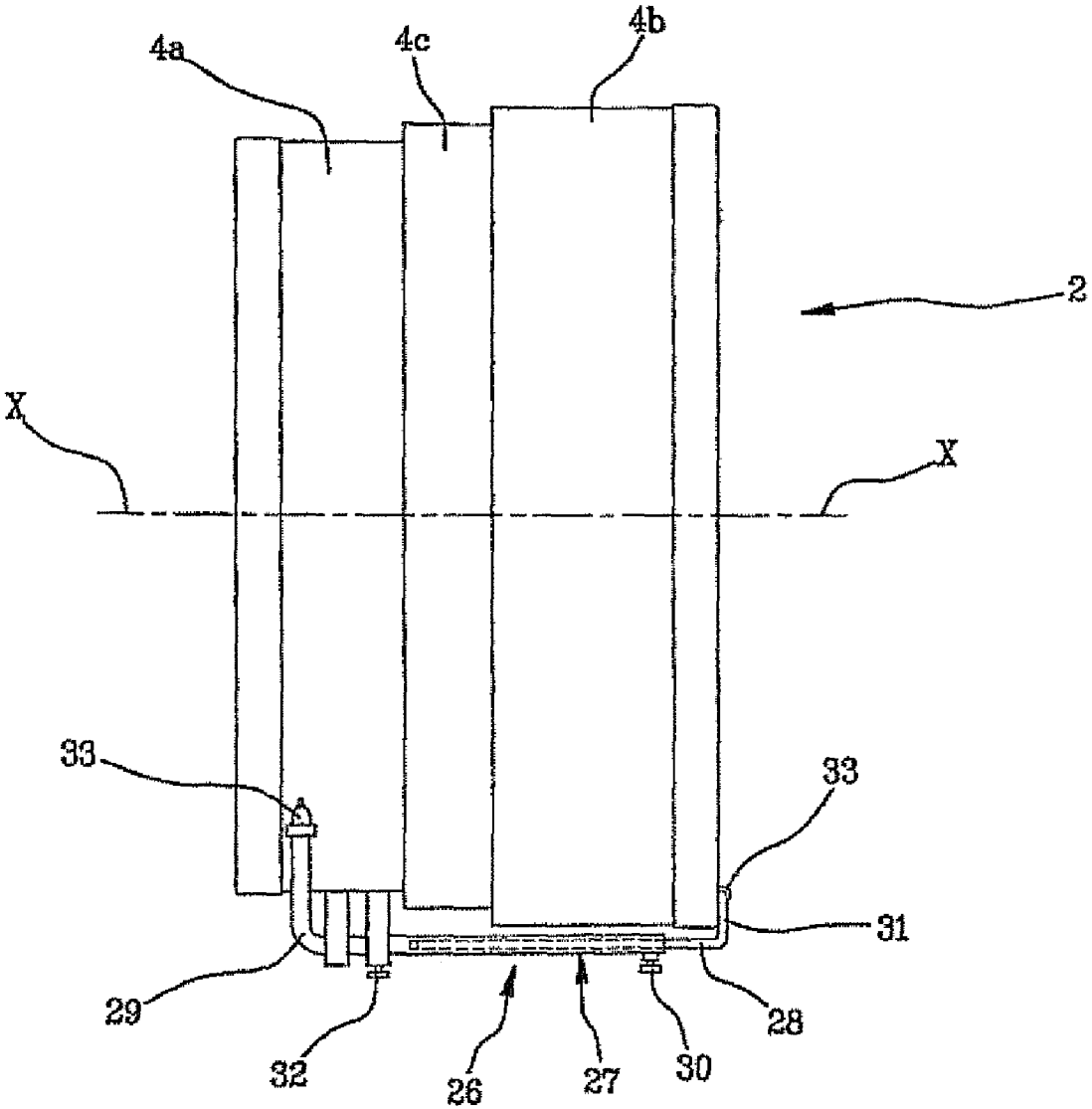
FIG. 6 shows a detail of the instrument of FIG. 1, not shown in FIG. 1, in a first operative condition.
Figure 7:
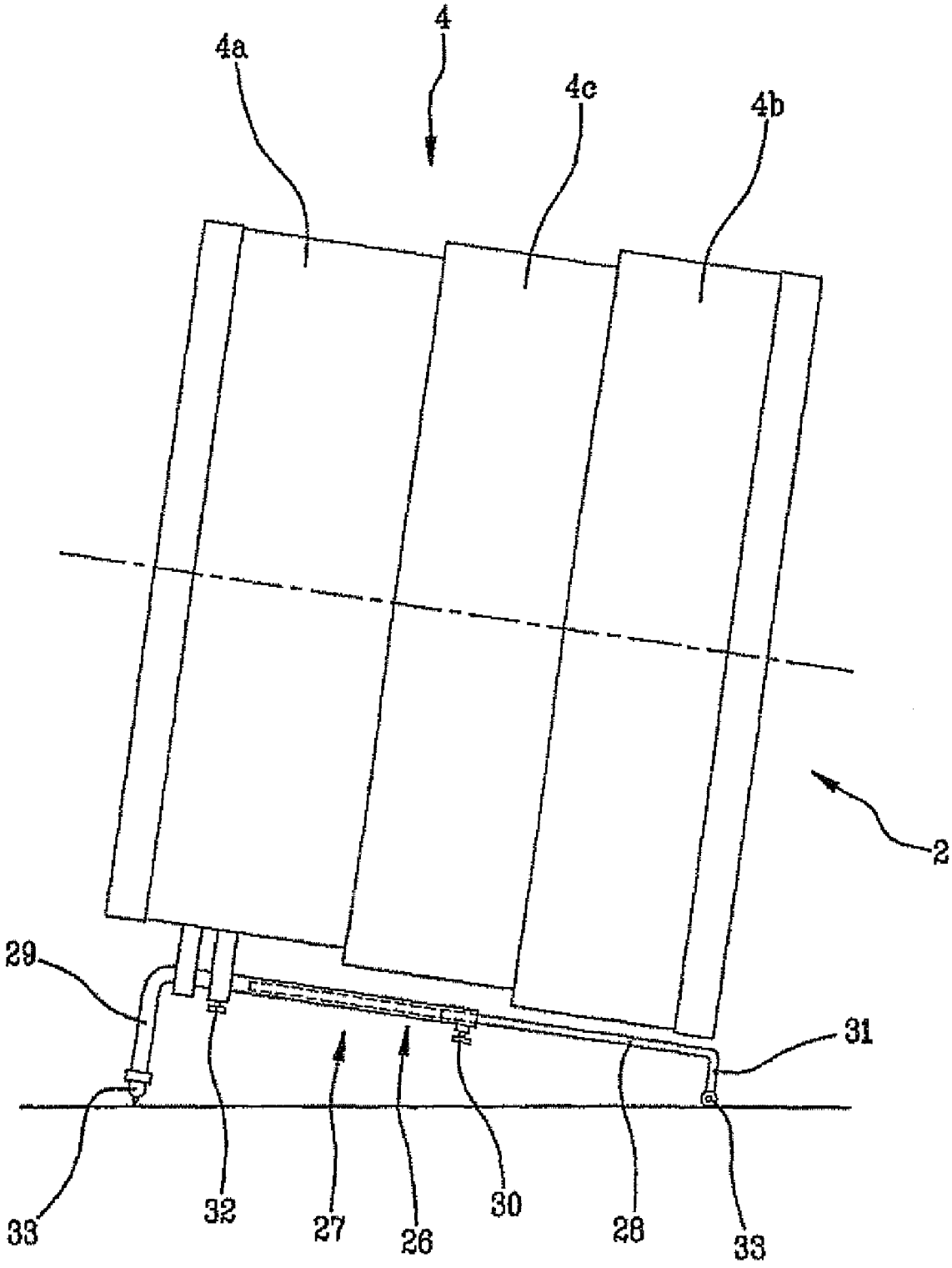
FIG. 7 shows the detail of FIG. 6 in a second operative condition.

The drum 1 further comprises fastening means 26 (shown in FIGS. 6 and 7 and 15 present in all the embodiments, though not shown) to retain the hollow bodies 4 in the closed configuration.

It should be stressed that the actuating means 9, independently of their embodiment, have a configuration of stable equilibrium such that the hollow bodies 4 are in the open configuration.

The actuating means 9 act directly only on the end hollow bodies 4*a*, 4*b* and they move them away from each other.

In this configuration, the central hollow bodies 4*c* are driven by the undercuts 7 and by the shoulders S in such a way as to project outside the hollow bodies that contain them in the closed configuration and positioned in the open configuration (as shown in FIGS. 1, 3, 4 and 5).

The actuating means 9 also oppose the translation of the hollow bodies 4 along the axis X when the drum is in use, preventing it from closing when in use. The fastening means 26 retain the hollow bodies 4 in the closed configuration opposing the opening forces of the actuating means 9, In particular, the fastening means 26 comprise at least one fastening element 27 substantially "C" shaped and rotatably fastened, in a central portion, to one of the hollow bodies, preferably to the end hollow body 4*b* with greater transverse section.

The fastening element is rotatably around an axis substantially parallel to the axis X of translation.

The fastening element 27 is movable at least between a retaining position in which 5 it engages an end hollow body (as shown in FIG. 6) and a position of release in which it is not engaged with any end hollow body (as shown in FIG. 7). The fastening element 27 comprises a first 28 and a second half-part 29 slidably coupled along a direction parallel to the axis X of translation.

The sliding of the first half-part 28 within the second half-part 29 is blocked by a 10 security dowel 30 that acts between the two half-parts.

The first half-part 28 comprises a portion 31 that extends, in closed configuration, above the end hollow body 4*a* on which the first half-part acts, and the second half-part 29 can be fastened, through a security dowel 32 to the end hollow body 4*b* whereon it stands, inhibiting any translation of the second half-part 29 relative to the end hollow body 4*b*.

Placing the portion 31 of the first half-part 28 above the end hollow body 4*a*, fastening the first half-part 28 to the second half-part 29 with the aid of the aforementioned security dowel 30 and fastening the second half-part to the other end hollow body 4*b* through the aforesaid security dowel 32, the drum I is forced into the closed configuration (shown in FIG. 6).

Unlocking the security dowel 32 that keeps the second half-part 29 to the end hollow body 4*b* and rotating the entire fastening element 27, the drum assumes the open configuration (as shown in FIG. 7) by effect of the actuating means 9. Advantageously, the free ends of the two half-parts 28, 29 comprise respective support feet 33 whose function is to support the drum I when in use (FIG. 7).

In particular, said support feet 33 contact the ground in the open configuration of the drum 1, thanks to a rotation of about 180° of the fastening element relative to the configuration assumed in the closed position.

Preferably, there are two fastening elements 27, in such a way as to provide four 30 support points for the drum 1.

The invention achieves the proposed object.

The telescopic configuration of the shell 2 enables to reduce the dimensions of the musical instrument during storage and transport.

The actuating means 9 also enable to make the musical instrument assume the open configuration, i.e. ready for the use of the instrument, in nearly instantaneous and automatic manner.

What is claimed is:

1. A percussion musical instrument comprising:

a beating surface and a shell, said beating surface being fastened to said shell;

wherein said shell comprises at least two hollow bodies movable relative to each other along a shared axis of translation at least between a closed configuration in which a hollow body contains at least partially the other hollow body and an open configuration in which said two hollow bodies are substantially superposed;

said musical instrument also comprising actuating means coupled inside the hollow bodies, to move said hollow bodies between the open configuration and the closed configuration;

wherein said actuating means have a degree of rotational freedom relative to said hollow bodies to enable said hollow bodies to rotate independently of each other around said shared axis of translation.

2. Musical instrument as claimed in claim 1, wherein said hollow bodies are mutually coupled telescopically to obtain said closed and open configuration.

3. Musical instrument as claimed in claim 1, comprising a first end hollow body provided with a closed surface opposite to the beating surface and a second end hollow body provided with said beating surface, between said two end hollow bodies there being one or more central hollow bodies.

4. Musical instrument as claimed in claim 1, wherein an end hollow body comprises an annular undercut positioned at a first end, an additional end hollow body being telescopically inserted in the end hollow body and comprising an annular projection engageable in said undercut to define a position of maximum extension of the two end hollow bodies, said position of maximum extension coinciding with said open configuration.

5. Musical instrument as claimed in claim 1, comprising fastening means for retaining said hollow bodies in the closed configuration.

6. Musical instrument as claimed in claim 1, wherein said actuating means comprise a first array of thruster elements active between an end hollow body and a first abutment surface and a second array of thruster elements active between a second end hollow body and a second abutment surface; said first and second abutment surface facing each other and being in mutual contact.

7. Musical instrument as claimed in claim 6, wherein each array of thruster elements comprises a first rod-like element hinged to an end hollow body and a second rod-like element; said second rod-like element being also hinged on said abutment surface; elastic means acting between said first and said second rod-like element to thrust an abutment surface against the other abutment surface.

8. Musical instrument as claimed in claim 1, wherein said actuating means comprise a structure substantially shaped as a pantograph, rotatably fastened to two end hollow bodies.

9. Musical instrument as claimed in claim 1, wherein said actuating means comprise a first support element fastened to a first end hollow body, a second support element fastened to a second end hollow body and an elastic element interposed between the two support elements; said elastic element being freely rotatably along the shared axis of translation relative to the support elements.

10. Musical instrument as claimed in claim 1, wherein said actuating means comprise a plurality of telescopic cylinders fastened to two end hollow bodies; said telescopic cylinders being provided with elastic means to extend completely.

11. Musical instrument as claimed in claim 5, wherein said fastening means comprise a fastening element substantially "C" shaped, rotatably fastened in a central portion, to one of said hollow bodies and movable at least between a retaining position in which the fastening element is engaged with end hollow bodies and a position of release in which the fastening element is not engaged with end hollow bodies.

12. Musical instrument as claimed in claim 11, wherein said fastening element comprises a first and a second half-part slidably coupled to said first half-part; said first half-part and said second half-part comprising, at respective free ends, support feet destined to support the instrument when in use.

13. Musical instrument as claimed in claim 2, comprising a first end hollow body provided with a closed surface opposite to the beating surface and a second end hollow body provided with said beating surface, between said two end hollow bodies there being one or more central hollow bodies.

14. Musical instrument as claimed in claim 2, wherein an end hollow body comprises an annular undercut positioned at a first end, an additional end hollow body being telescopically inserted in the end hollow body and comprising an annular projection engageable in said undercut to define a position of maximum extension of the two end hollow bodies, said position of maximum extension coinciding with said open configuration.

15. A percussion musical instrument comprising:

a beating surface and a shell, said beating surface being fastened to said shell; wherein said shell comprises at least two hollow bodies movable relative to each other along a shared axis of translation at least between a closed configuration in which a hollow body contains at least partially the other hollow body and an open configuration in which said two hollow bodies are substantially superposed;

said musical instrument also comprising actuating means coupled inside the hollow bodies, to move said hollow bodies between the open configuration and the closed configuration;

wherein said actuating means comprise a first array of thruster elements active between an end hollow body and a first abutment surface and a second array of thruster elements active between a second end hollow body and a second abutment surface; said first and second abutment surface facing each other and being in mutual contact.

16. A percussion musical instrument comprising:

a beating surface and a shell, said beating surface being fastened to said shell; wherein said shell comprises at least two hollow bodies movable relative to each other along a shared axis of translation at least between a closed configuration in which a hollow body contains at least partially the other hollow body and an open configuration in which said two hollow bodies are substantially superposed;

said musical instrument also comprising actuating means coupled with the hollow bodies, to move said hollow bodies between the open configuration and the closed configuration;

wherein said actuating means comprise a plurality of telescopic cylinders fastened to two end hollow bodies; said telescopic cylinders being provided with elastic means to extend completely.

17. A percussion musical instrument comprising:

a beating surface and a shell, said beating surface being fastened to said shell; wherein said shell comprises at least two hollow bodies movable relative to each other along a shared axis of translation at least between a closed configuration in which a hollow body contains at least partially the other hollow body and an open configuration in which said two hollow bodies are substantially superposed;

said musical instrument also comprising actuating means coupled inside the hollow bodies, to move said hollow bodies between the open configuration and the closed configuration;

wherein said percussion musical instrument comprising fastening means which comprise a fastening element substantially "C" shaped, rotatably fastened in a central portion, to one of said hollow bodies and movable at least between a retaining position, in which the fastening element is engaged with end hollow bodies for retaining said hollow bodies in the closed configuration, and a position of release, in which the fastening element is not engaged with end hollow bodies.

* * * * *